US007501594B2

(12) United States Patent
Fulton et al.

(10) Patent No.: US 7,501,594 B2
(45) Date of Patent: Mar. 10, 2009

(54) SELF CONTAINED ACTUATOR FOR REFRIGERATOR DISPENSER FUNCTIONS

(75) Inventors: Timothy Alan Fulton, Evansville, IN (US); Gary William Wilson, Sr., Sellersburg, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 527 days.

(21) Appl. No.: 11/271,401

(22) Filed: Nov. 10, 2005

(65) Prior Publication Data

US 2007/0102447 A1 May 10, 2007

(51) Int. Cl.
*H01H 1/58* (2006.01)

(52) U.S. Cl. ..... 200/51 R

(58) Field of Classification Search ..... 200/51 R, 200/295, 296, 144.5, 148
See application file for complete search history.

(56) References Cited

U.S. PATENT DOCUMENTS

| | | | | |
|---|---|---|---|---|
| 3,694,595 | A * | 9/1972 | Horecky | 200/295 |
| 3,934,757 | A | 1/1976 | Malek et al. | 222/76 |
| 4,778,965 | A * | 10/1988 | Valenzona | 200/296 |
| 5,089,671 | A * | 2/1992 | Ranetkins | 200/5 A |
| 5,526,854 | A | 6/1996 | Unger | 141/351 |
| 5,743,106 | A | 4/1998 | Lee | 62/389 |
| 5,768,905 | A | 6/1998 | Oh | 62/264 |
| 5,857,596 | A | 1/1999 | Lee | 222/509 |
| 5,881,930 | A | 3/1999 | Lee | 222/509 |
| 6,274,831 | B1 * | 8/2001 | Kim et al. | 200/296 |
| 6,425,425 | B2 | 7/2002 | Bianchi et al. | 141/362 |
| 6,651,449 | B2 | 11/2003 | Heims et al. | 62/98 |
| 6,679,082 | B1 | 1/2004 | Tunzi | 62/344 |
| 6,681,960 | B2 | 1/2004 | Garman | 222/189.11 |
| 6,763,976 | B2 | 7/2004 | Mitchell et al. | 222/108 |
| 6,768,070 | B2 * | 7/2004 | Lewison et al. | 200/296 |
| 6,804,974 | B1 | 10/2004 | Voglewede et al. | 62/264 |
| 2004/0007009 | A1 | 1/2004 | Wing et al. | 62/338 |

* cited by examiner

*Primary Examiner*—Edwin A. Leon
(74) *Attorney, Agent, or Firm*—Kirk Goodwin; Michael D. Lafrenz

(57) ABSTRACT

A ready to attach actuation device module is provided for use with a dispenser, such as an ice or water dispenser in a refrigerator. The module includes an electrical actuation device, a wiring lead extending from the actuation device and an electrical connector attached at an end of the wiring lead. A housing encloses the actuation device and at least a portion of the wiring lead. The module incorporates an attachment mechanism which is engageable with the dispenser. The housing includes all stylings for the actuation device module.

19 Claims, 8 Drawing Sheets

SELF CONTAINED ACTUATOR FOR REFRIGERATOR DISPENSER FUNCTIONS

BACKGROUND OF THE INVENTION

The present invention relates generally to refrigeration appliances with dispensers for water, ice or both.

Refrigeration appliances with having dispensers are well known, such as disclosed in U.S. Pat. Nos. 6,804,974, 6,763,976 and 6,425,425.

In several of these patents, the actuating device for the dispenser comprises a mechanical lever or paddle which must be attached separately to the dispenser housing or refrigeration appliance cabinet, as well as an electrical switch which is activated by the lever or paddle, and also must be separately attached to the dispenser housing or cabinet. In other arrangements, the actuation device is composed of several components which are assembled onto the refrigerator cabinet or dispenser housing separately, usually with separate fasteners. Finishing elements, including covers, indicia or other markings, and similar styling elements, are applied or attached separately after the other components have been assembled to the cabinet or dispenser. This type of assembly process results in a large number of individual parts being assembled onto the dispenser housing or refrigerator cabinet at the assembly line, increasing the complexity and cost of the appliance.

It would be an improvement in the art if an actuator for a refrigeration appliance dispenser were provided which is fully assembled and complete when it is brought to the assembly line to mate with the dispenser housing or the refrigeration appliance.

SUMMARY OF THE INVENTION

The present invention provides a self contained actuation device in the form of an actuator module for a refrigeration appliance dispenser which is fully assembled, complete and ready to attach when it is brought to the assembly line to mate with the dispenser housing or the refrigeration appliance. All of the components necessary for the operation of the actuator are contained within a housing, that also contains all of the styling elements for the actuator. The module contains an attachment mechanism which allows the module to be attached to the dispenser housing or the refrigeration appliance without any additional fasteners.

In an embodiment of the invention, a ready to attach actuation device module is provided for use with a refrigerator dispenser which includes an electrical actuation device, a wiring lead extending from the actuation device, an electrical connector attached at an end of the wiring lead and a housing enclosing the actuation device and at least a portion of the wiring lead and including all stylings for the actuation device module. An attachment mechanism engageable with the refrigerator dispenser or refrigeration appliance cabinet is also a part of the module.

In an embodiment, the actuation device comprises an electrical switch.

In an embodiment, the electrical connector is a male connector.

In an embodiment, the housing is formed in two parts, one part including the attachment mechanism, and a second part being a front cover including the stylings.

In an embodiment, the attachment mechanism includes projecting clips formed on the one part of the housing.

In an embodiment, the attachment mechanism includes a spring member arranged to hold the clips in tight engagement with the refrigerator dispenser.

In an embodiment, the attachment mechanism includes an adhesive.

In an embodiment, the said actuation device includes a printed circuit board.

In an embodiment, the actuation device includes a depressible pad.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

The present invention finds particular utility in a domestic refrigerator having a dispenser, such as a water dispenser, an ice dispenser, or both. The invention has utility in other environments, such as stand alone dispensers or other appliances requiring an actuator for operating various components in the appliance. In order to provide a disclosure of the invention, the embodiment of a refrigeration appliance with a water and ice dispenser is shown and illustrated, it being understood that the scope of the invention is not limited to such an arrangement.

Figure 1:
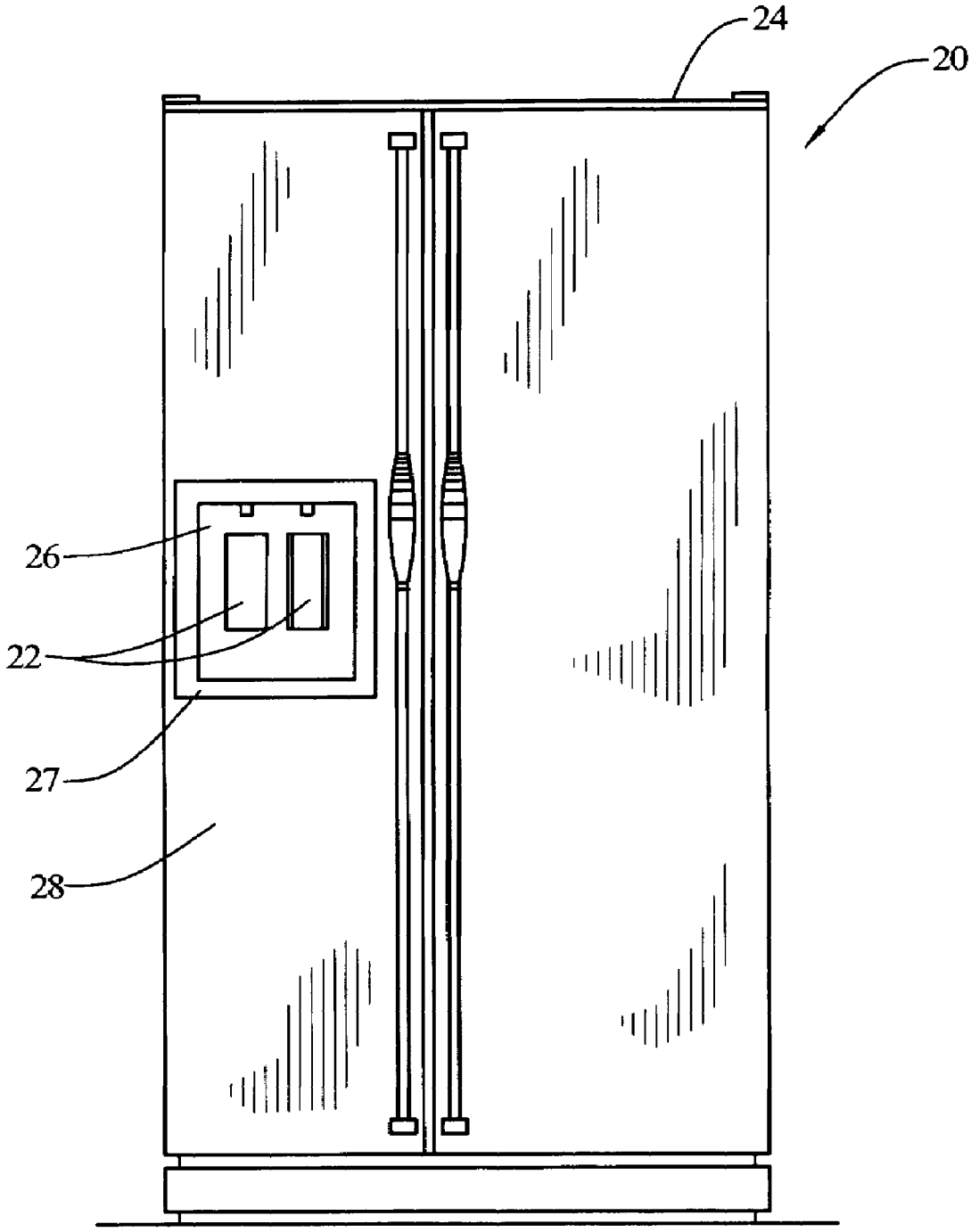
FIG. 1 is a front elevational view of a refrigeration appliance embodying the principles of the present invention.
Figure 2:
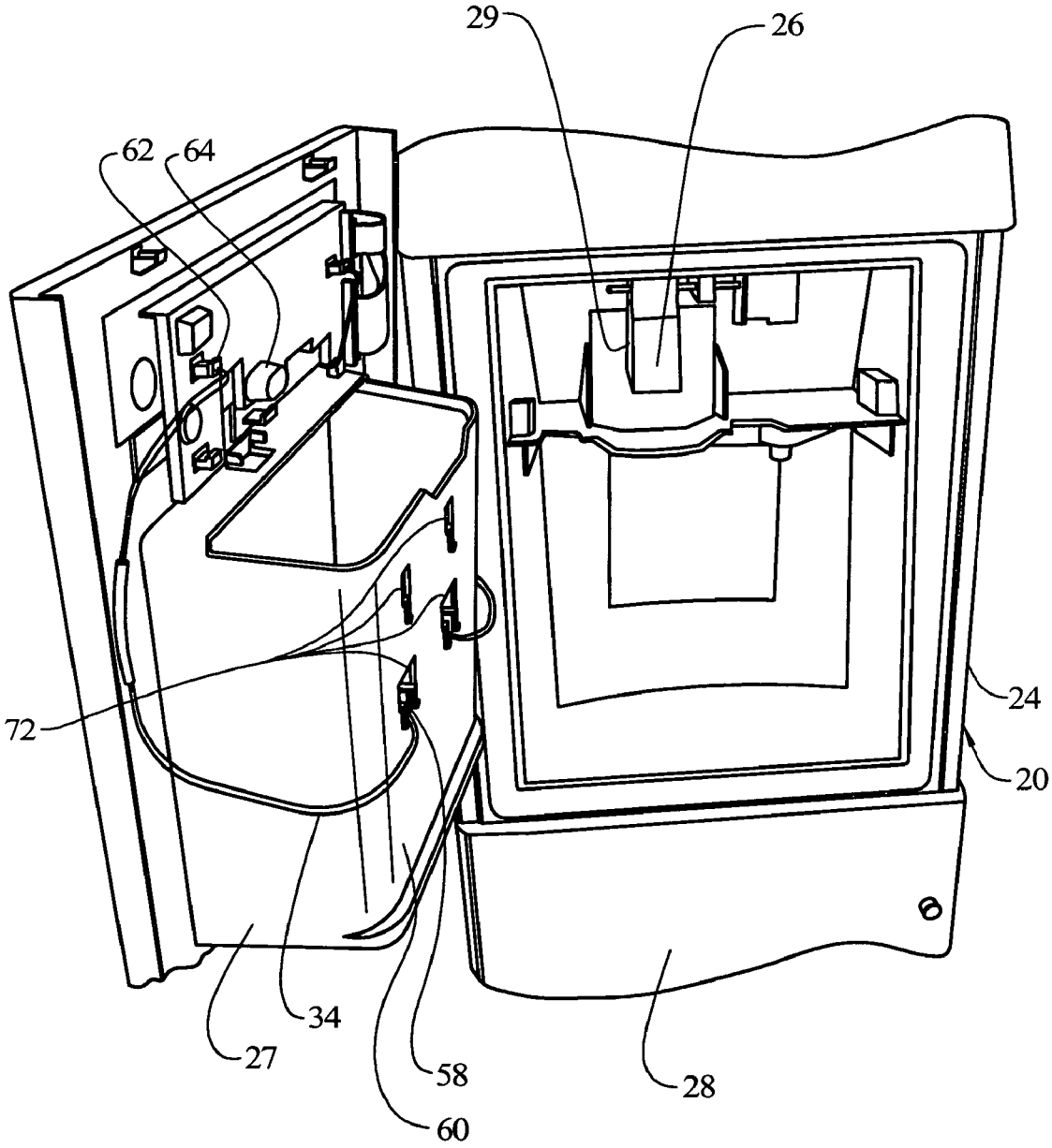
FIG. 2 is a partial rear perspective view of a portion of the dispenser housing of the refrigeration appliance of FIG. 1.
Figure 3:
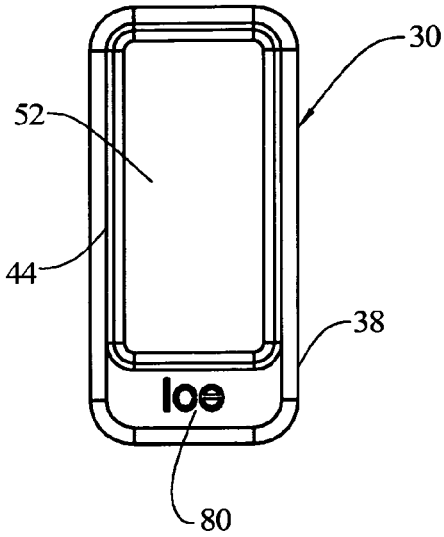
FIG. 3 is a front elevational view of an embodiment of the actuator device module.

FIG. 1 illustrates a refrigeration appliance 20, such as a refrigerator/freezer, which includes two dispenser actuators 22 according to the present invention. If only one item is to be dispensed, only a single dispenser actuator 22 would be required. The refrigeration appliance 20 includes a cabinet 24 and a dispensing device 26, such as a water dispenser or ice dispenser or both, located in a dispenser housing 27 which, in turn, is mounted in a door 28 of the cabinet. In this manner, the dispenser housing 27 forms a part of the cabinet 24. The rear side of the dispenser housing 27 is shown in FIG. 2, prior to complete assembly of the dispenser housing with the door 28. Typically the dispensing device 26 includes an electrically operated dispensing mechanism 29 which requires the dispenser actuator 22 to cause the dispensing to begin or terminate operation.

An example of a ready to attach actuation device module 30 which may be used with the refrigerator dispensing device 26 is illustrated in FIGS. 3-6. The actuation device module 30 includes an electrical actuation device 32 and a wiring lead 34 extending from the actuation device. An electrical connector 36 is attached at a distal end of the wiring lead 34. A housing 38 encloses the actuation device 32 and at least a portion of the wiring lead 34, with a remainder of the lead extending outside of the housing. The housing 38 also incorporates an integral attachment mechanism 40 engageable with the refrigerator dispenser housing 27 and includes all stylings for the actuation device module 30.

The housing 38 may be formed in two parts, a first part 42 including the attachment mechanism 40, and a second part 44 being a front cover including the stylings. The two parts 42, 44 preferably snap together so that no additional fasteners are required to hold the parts together. The second part 44 may be made, at least partially, of a material, such as silicone rubber, which is flexible and elastic so that at least a portion of the second part can be depressed or moved relative to the remainder of the housing 38 and the various components in the housing, such as at least part of the actuation device 32.

The actuation device 32 shown in FIGS. 3-6 could comprise an electrical switch in many different configurations. For example, the actuation device 32 could be one or more open circuit elements 46 carried on or printed on a circuit board 48 and closed by contact of conducting elements 50 carried on a movable portion or pad 52 of the second part 44 of the housing 38. The circuit board 48 may be secured to the first part 42 of the housing 38 by an adhesive layer 54 interposed between the circuit board and the first part of the housing. The conducting elements 50 could be elements such as carbon disks or metal disks attached to the second part 44 of the housing 38 which press against the open circuit elements 46 on the circuit board 48 in such a way as to bridge a gap 55 between adjacent open circuit elements to close a circuit. As illustrated in this embodiment, the movable portion 52 of the housing 38 may occupy a large portion of the second part 44, giving the user a large area to press against for activation. In this embodiment, one part 50 of the actuation device 32 can be carried on the second part 44 of the housing 38, or on a movable portion 52 of the second part, to be selectively moved into or out of contact with another part 46 of the actuation device to cause the actuation to occur or not occur.

While the actuation device 32 has been described as a normally open switch, closed by pressing against the second part 44 of the housing 38, the actuation device could also be provided as a normally closed switch, opened by pressing against the second part of the housing, in a way known by those of skill in the art. Either type of actuation device could be utilized with appropriate modifications to the control circuitry, as would be well known to artisans in this field.

The actuation device 32 has the wiring lead 34 extending away from it so that an appropriate signal can be transmitted by the actuation device to the dispensing device 26. The lead 34 may comprise individual wires, a ribbon cable, or other known flexible conductive constructions. The lead 34 may extend through an opening 56 in the first part 42 of the housing 38, and from there through an opening 58 in a wall 60 of the dispenser housing 27 or the refrigerator cabinet 24 (FIG. 2). The wiring lead 34 may be secured to the circuit board 48 with a strain relief member 61 to prevent an unintended disconnect between the wiring lead and the circuit board.

In order to easily and quickly make the connection from the actuation device 32 to the dispensing device 26, the electrical lead 34 includes the connector 36 at an end thereof. This connector 36 can be one of many different configurations or constructions, as is known in the art, from a spade type connector to a plastic snap connector, such as a male connector that mates with a complementary connector 62, such as a female connector, which then is connected to the dispensing device 26 or a control element 64 for the dispensing device.

Figure 4:
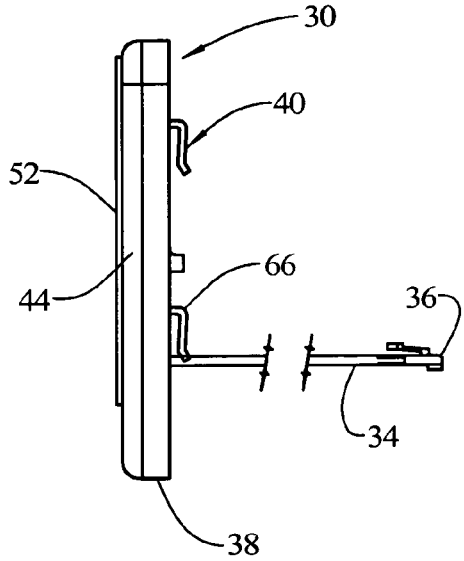
FIG. 4 is a side elevational view of the actuator device module of FIG. 3.
Figure 5:
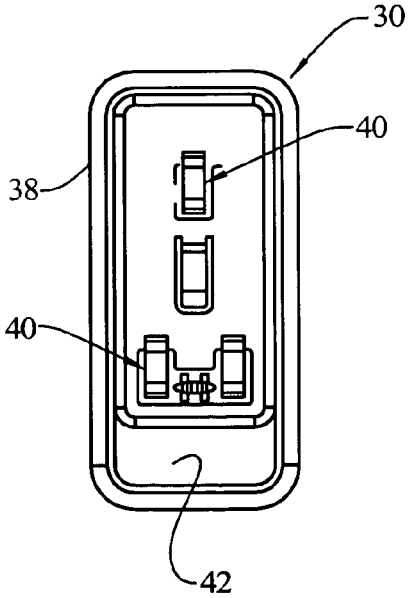
FIG. 5 is a rear elevational view of the actuator device module of FIG. 3.
Figure 6:
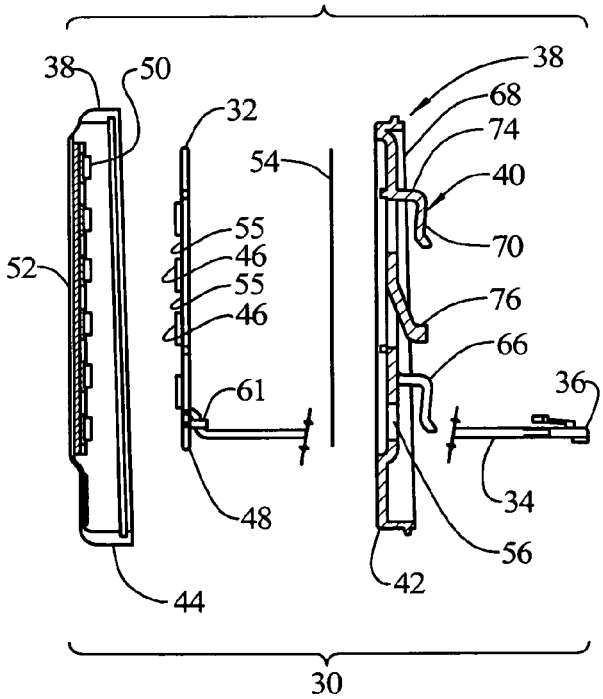
FIG. 6 is an exploded side elevational view of the components of the actuator device module of FIG. 3.
Figure 7:
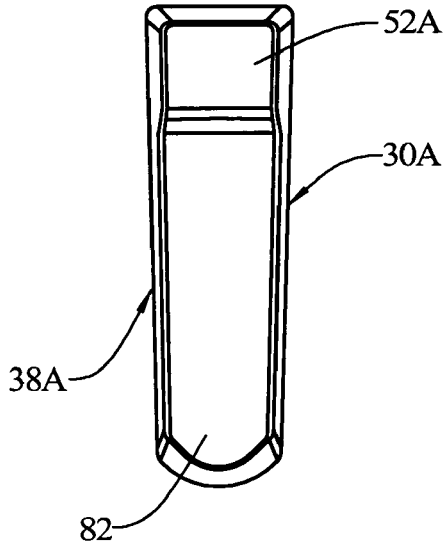
FIG. 7 is a front elevational view of another embodiment of the actuator device module.
Figure 8:
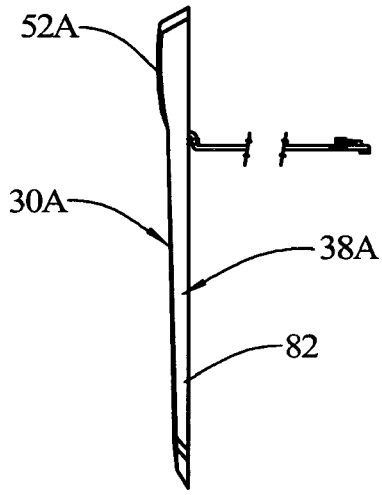
FIG. 8 is a side elevational view of the actuator device module of FIG. 7.
Figure 9:
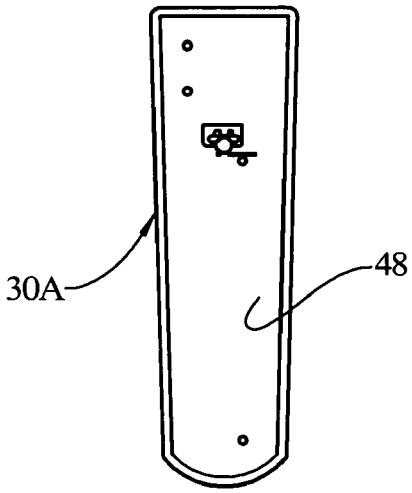
FIG. 9 is a rear elevational view of the actuator device module of FIG. 7.
Figure 10:
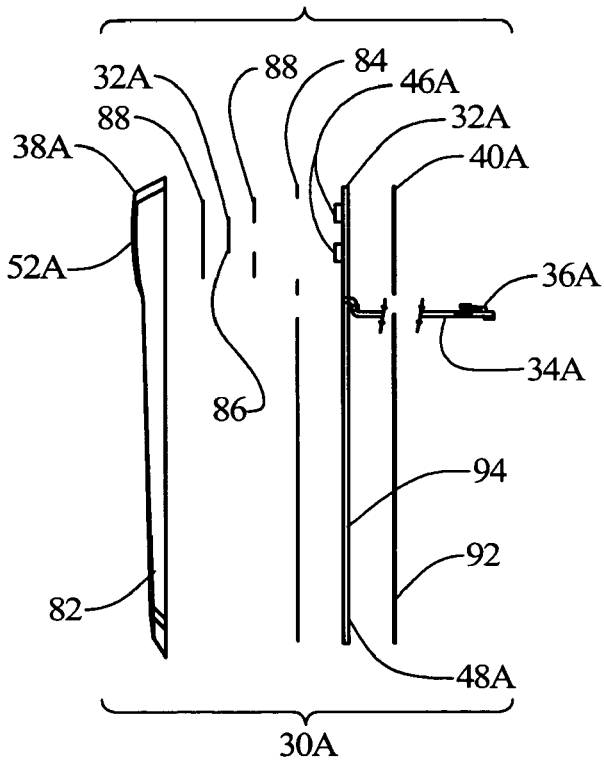
FIG. 10 is an exploded side elevational view of the components of the actuator device module of FIG. 7.

The attachment mechanism 40 may be integral with the housing 38, that is, formed as one piece with the housing, so that no additional or separate fasteners are needed to secure the housing to the dispensing device 26. As illustrated in FIGS. 4-6, the attachment mechanism 40 may include one or more projecting clips or fingers 66 that have an L shape, projecting from a back side 68 of the first part 42 of the housing 38 with a long leg 70 of the L extending generally perpendicular to the back side of the first part. This type of attachment mechanism 40 would be designed to be received in openings 72 in the wall 60 of the dispenser housing 27, or the cabinet 24 of the refrigeration appliance 20, with the long leg 70 of the L passing through the opening, and then the entire housing 38 being moved downwardly so that a short leg 74 of the L rests on a lower edge of the opening. The first housing part 42, as well as the clips 66 may be made of a plastic material, and the clips may have a springiness to them, so that the long leg 70 of the L will press against the wall 60 that the opening 72 is in to hold the housing 38 tightly against the wall. Further, the first part 42 of the housing 38 may also include one or more spring members in the form of spring type fingers 76 which would press against an opposite side of the wall 60 to further ensure that the housing 38 would be held tightly against the wall.

In another embodiment, the attachment mechanism 40 could include an adhesive applied on the back side of the first housing part 50 as described in more detail below. A combination of adhesive and mechanical attachment mechanisms could also be utilized.

The stylings which may be incorporated into the housing 38, and particularly the second part 44, include the shape, contours and configuration of the housing, the surface texture, the color and general appearance, as well as lighting features, such as backlighting, LEDs, and other known lighting and illumination elements. Other stylings include indicia, such as, for example, the words "ice" 80 or "water" or similar appropriate words or symbols, as well as other markings including model names, trademarks, design elements, etc. In this manner, additional overlays, labels, covers, bezels, and similar items would not be required for use with the actuation device module 30 in that it would be complete in and of itself, and would be ready to assemble onto the dispenser housing 27 or refrigeration appliance cabinet 24.

Another example of a ready to attach actuation device module 30A which may be used with the refrigerator dispensing device 26 is illustrated in FIGS. 7-10. The actuation device module 30A includes an electrical actuation device 32A and a wiring lead 34A extending from the actuation device. An electrical connector 36A is attached at an end of the wiring lead 34A. A housing 38A encloses the actuation device 32A and at least a portion of the wiring lead 34A. The housing also includes all stylings for the actuation device module. The module 30A incorporates an attachment mechanism 40A engageable with the dispenser housing 27 or the refrigeration appliance cabinet 24.

In this example, the housing 38A may be formed in a single part 82 being a front cover including the stylings. The housing 38A attaches to other components of the actuation device module 30A by an adhesive layer 84 interposed between the housing and at least one other component of the actuation device so that no additional fasteners are required to hold the components together. The housing 38A may be made, at least partially, of a material, such as silicone rubber, which is flexible and elastic so that at least a portion of the housing can be depressed or moved relative to the remainder of the various components in the housing, such as at least part of the actuation device 32A.

The actuation device 32A shown in FIGS. 7-10 could comprises an electrical switch in many different configurations. For example, in these figures it comprises an open circuit element 46A carried on or printed on a circuit board 48A and closed by contact of a dome element 86 interposed between dome retainer elements 88, which in turn are interposed between a movable portion 52A of the housing 38A and the circuit board. The circuit board 48A may be secured to the housing 38A by the adhesive layer 84 interposed between the circuit board and the housing. As illustrated in this embodiment, the movable portion 52A of the housing 38A may occupy a relatively small portion of the housing, giving a different visual appearance for the actuation device module 30A. In this embodiment, one part 86 of the actuation device 32A can be interposed between the housing 38A, or a movable portion 52A of the housing, and another part 46A of the actuation device, to be selectively moved into or out of contact with the other part 46A to cause the actuation to occur or not occur.

The actuation device 32A has the electrical lead 34A extending away from it so that an appropriate signal can be transmitted by the actuation device to the dispensing device 26. The lead 34A and the connector 36A may be constructed in various configurations as discussed above.

The attachment mechanism 40A in this embodiment is illustrated as an adhesive layer 92 applied on a back side 94 of the circuit board 48A. This adhesive layer 92 can be applied directly to the wall 60 of the dispenser housing 27 or refrigerator cabinet 24 to hold the actuator device module 30A securely in place.

Similar stylings as described above may be used with this embodiment of the actuation device module 30A so that it would be complete in and of itself, and would be ready to assemble onto the dispenser housing 27 or refrigeration appliance cabinet 24.

Figure 11:
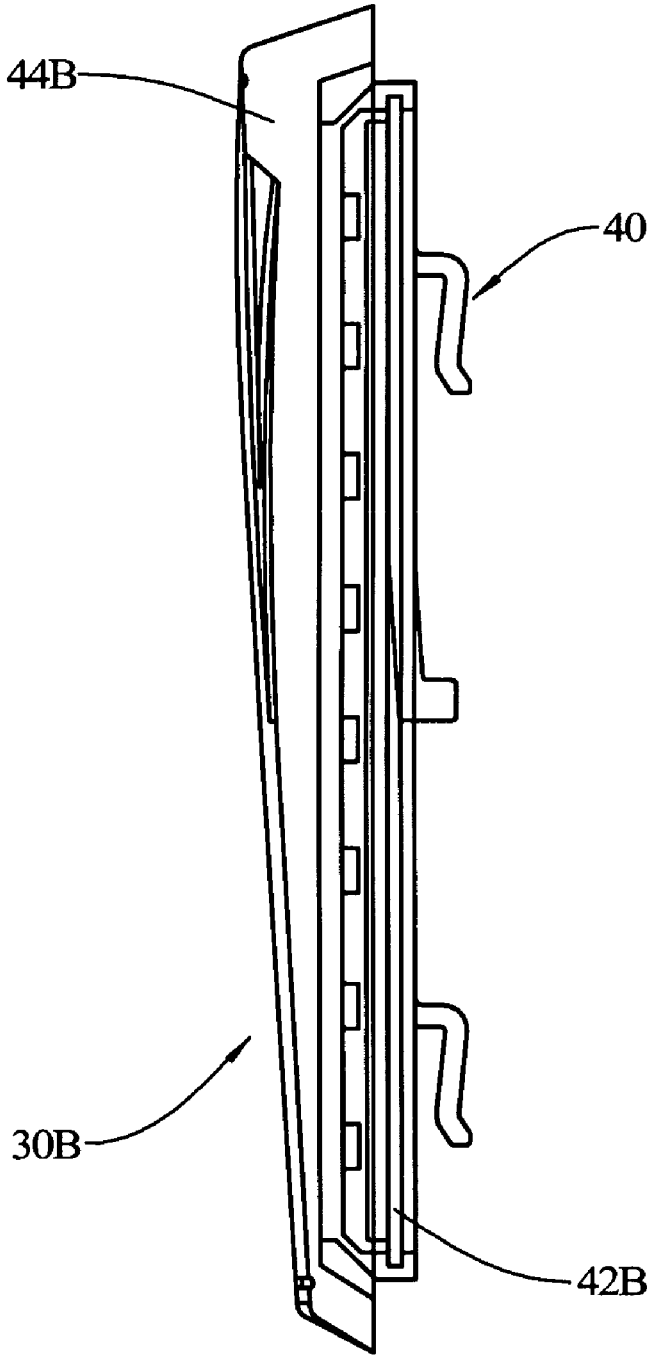
FIG. 11 is a side elevational view of another embodiment of the actuator device module.
Figure 12:
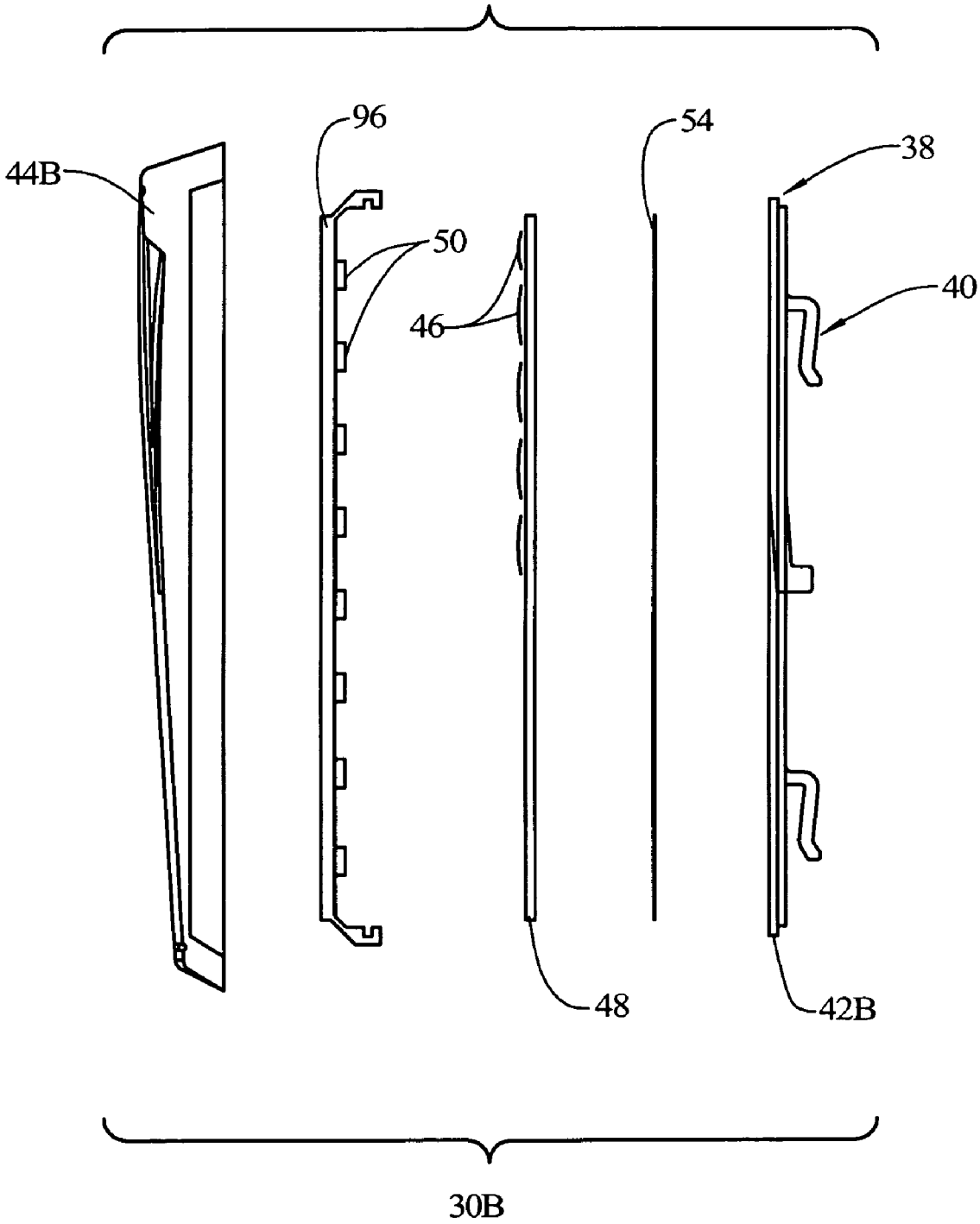
FIG. 12 is an exploded side elevational view of the components of the actuator device module of FIG. 11.

Another example of a ready to attach actuation device module 30B which may be used with the refrigerator dispensing device 26 is illustrated in FIGS. 11-12. The actuation device module 30B in this embodiment is very similar to the module shown in FIGS. 3-6, with a primary difference being a separate actuation device element 96 which carries the contact elements 50, rather than forming them integrally on the second housing part 44B. Although a wiring lead is not shown with respect to this embodiment, and subsequent embodiments, that is only for reason of clarity, in that the same type of wiring lead and electrical connector would be used with these embodiments.

Figure 13:
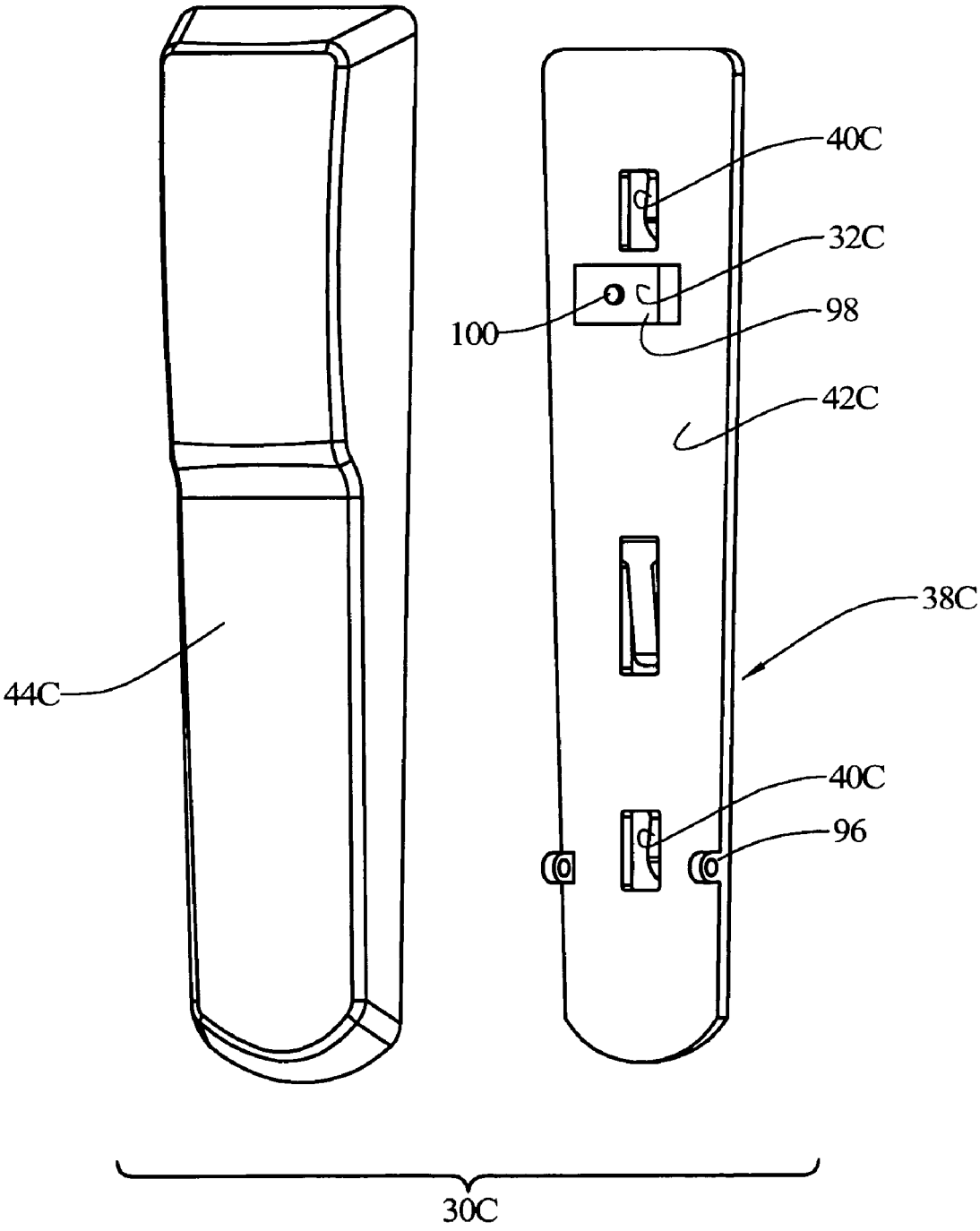
FIG. 13 is a front perspective exploded elevational view of another embodiment of the actuator device module.

Another example of a ready to attach actuation device module 30C which may be used with the refrigerator dispensing device 26 is illustrated in FIG. 13. The actuation device module 30C includes an electrical actuation device 32C and a wiring lead (not shown) extending from the actuation device. An electrical connector (not shown) is attached at an end of the wiring lead. A housing 38C encloses the actuation device 32C and at least a portion of the wiring lead. The housing 38C also incorporates an integral attachment mechanism 40C engageable with the refrigerator dispenser housing 27 and includes all stylings for the actuation device module.

The housing 38C may be formed in two parts, a first part 42C including the attachment mechanism 40C, and a second part 44C, being a front cover including the stylings. The two parts preferably snap together so that no additional fasteners are required to hold the parts together. The second part 44C may be made, at least partially, of a material, such as silicone rubber, which is flexible and elastic so that at least a portion of it can be depressed or moved relative to the remainder of the housing 38C and the various components in the housing, such as at least part of the actuation device 32C. The second part 44C may also be made of a rigid material and attached to the first part 42C in a pivoting manner, such as by a connection to pivot ears 96 on the first part engaged by pivot pins (not visible) carried on the second part.

The actuation device 32C shown in FIG. 13 could comprises an electrical switch in many different configurations. For example, it could be a sealed switch or microswitch 98 having a movable actuator element 100 for changing the state of the switch. The switch 98 may be secured to the first housing part 42C, for example, by an adhesive.

Similar electrical lead, connector, attachment mechanism and stylings as described above may be used with this embodiment.

Figure 14:
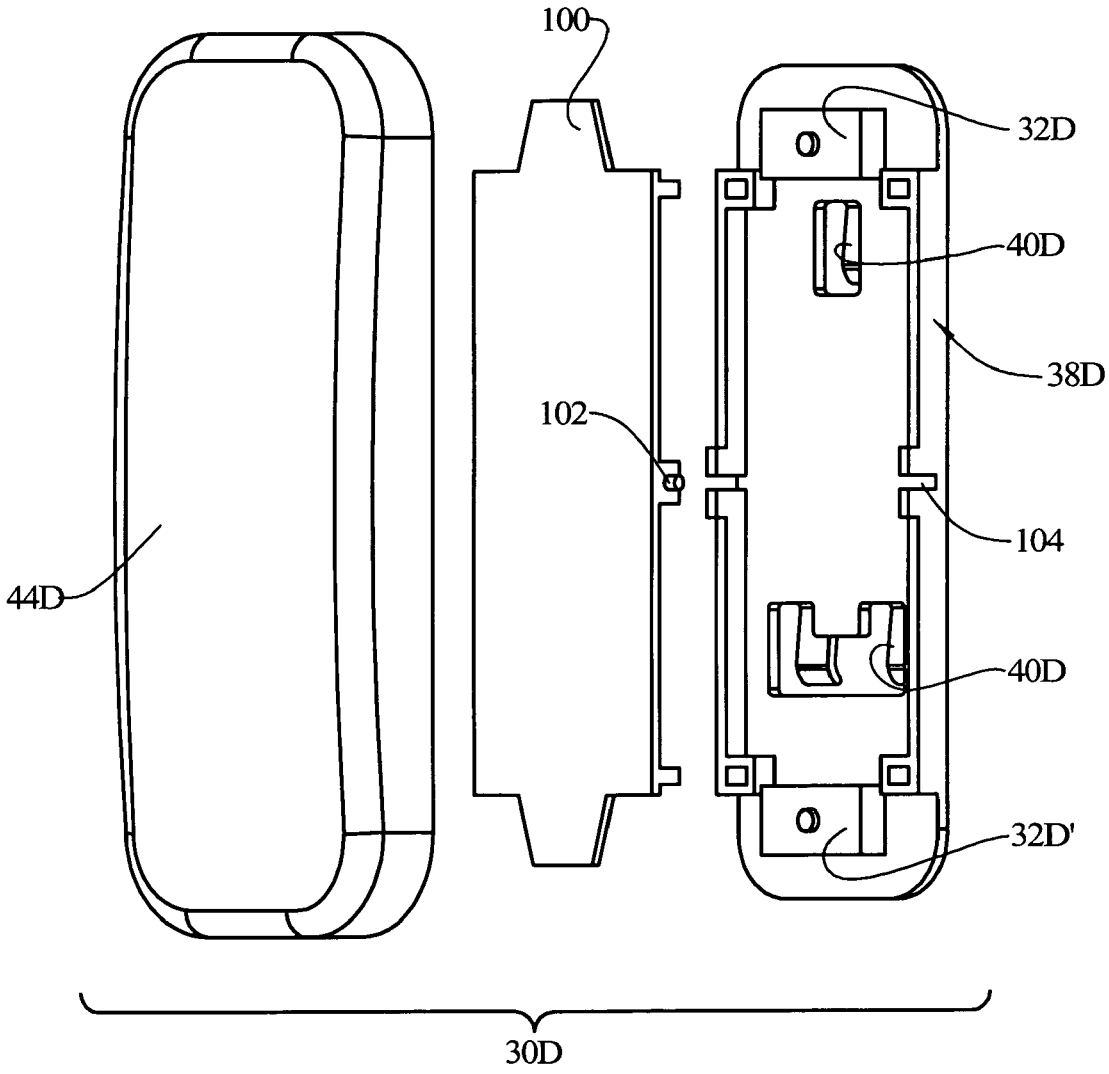
FIG. 14 is a front perspective exploded elevational view of another embodiment of the actuator device module.

Another example of a ready to attach actuation device module 30D which may be used with the refrigerator dispensing device 26 is illustrated in FIG. 14. The actuation device module 30D includes an electrical actuation device 32D and a wiring lead (not shown) extending from the actuation device. An electrical connector (not shown) is attached at an end of the wiring lead. A housing 38D encloses the actuation device 32D and at least a portion of the wiring lead. The housing 38D also incorporates an integral attachment mechanism 40D in a first housing part 42D engageable with the refrigerator dispensing device 26 and includes all stylings for the actuation device module.

This embodiment is very similar to the embodiment of FIG. 13 with a primary difference being that a second part 44D of the housing 38D is arranged to pivot about a center point through the intermediary of an actuation plate 100 having centrally located pivot pins 102 which are received in pivot slots 104 on the first housing part 42D. The electrical actuation device 32D may be accompanied by a second electrical actuation device 32D' which can be operated by pressing a lower part of the second housing part 44D. Appropriate biasing elements, such as springs, may be provided to urge the second housing part 44D and the actuation plate 100 to a neutral position after operation of either electrical actuation device 32D, 32D'

In each of these embodiments, the actuation device 32 is an electrical component that can render a normally open circuit closed, or a normally closed circuit open, upon a pressing against or engagement of an activation surface on the housing 38. The actuation device 32 might also comprise a proximity sensor, such as sensing the proximity of a magnet, that does not even require contact or pressing.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A self contained actuator for refrigerator dispenser functions comprising:

a housing, an actuation device located in said housing, a wiring lead leading from said actuation device and exiting said housing to a distal end;

an electrical connector at said distal end of said wiring lead; and an attachment mechanism engageable with a refrigeration appliance cabinet to secure said actuation device on said cabinet;

said housing including all stylings to render said actuator complete;

said housing being formed in two parts, a first part including said attachment mechanism, and a second part being a front cover including said stylings, with said two parts being secured together without the use of separate mechanical fasteners;

said attachment mechanism comprising at least two springy clips extending from said first part of said housing and having an L shape, with a long leg portion extendable through an opening in a wall of the refrigeration appliance cabinet and pressable against a surface of said cabinet wall facing away from said housing to hold said housing against said cabinet wall and a short leg portion restable on a lower edge of said opening to support said housing on said cabinet wall, and at least one spring member positioned between said housing and said cabinet wall to press against a surface of said cabinet wall facing towards said housing.

2. A self contained actuator according to claim 1, wherein said actuation device comprises an electrical switch.

3. A self contained actuator according to claim 1, wherein said electrical connector is a male snap connector.

4. A self contained actuator according to claim 1, wherein said attachment mechanism includes an adhesive.

5. A self contained actuator according to claim 1, wherein said actuation device includes a printed circuit board.

6. A self contained actuator according to claim 1, wherein said housing includes a depressible pad.

7. A self contained actuator according to claim 1, wherein said actuation device includes a strain relief member for securing said wiring lead to said actuation device.

8. A self contained actuator according to claim 1, wherein said housing parts are secured together with an adhesive.

9. A self contained actuator according to claim 1, wherein said housing parts are secured together with a snap fit.

10. A ready to attach actuation device module for use with a dispenser comprising:

an electrical actuation device;

a wiring lead extending from said actuation device;

an electrical connector attached at an end of said wiring lead;

a housing enclosing said actuation device and at least a portion of said wiring lead and including all stylings for said actuation device module; and an attachment mechanism engageable with said dispenser;

said housing being formed in two parts, a first part including said attachment mechanism, and a second part being a front cover including said stylings, with said two parts being secured together without the use of separate mechanical fasteners;

said attachment mechanism comprising at least two springy clips extending from said first part of said housing and having an L shape, with a long leg portion extendable though an opening in a wall of the dispenser and pressable against a surface of said dispenser wall facing away from said housing to hold said housing against said dispenser wall and a short leg portion restable on a lower edge of said opening to support said housing on said dispenser wall, and at least one spring member positioned between said housing and said dispenser wall to press against a surface of said dispenser wall facing towards said housing.

11. A ready to attach actuation device module according to claim 10, wherein said actuation device comprises an electrical switch.

12. A ready to attach actuation device module according to claim 10, wherein said electrical connector is a male snap connector.

13. A ready to attach actuation device module according to claim 10, wherein said attachment mechanism includes an adhesive.

14. A ready to attach actuation device module according to claim 10, wherein said actuation device includes a printed circuit board.

15. A ready to attach actuation device module according to claim 10, wherein said housing includes a depressible pad.

16. A ready to attach actuation device module according to claim 10, wherein said actuation device includes a strain relief member for securing said wiring lead to said actuation device.

17. A ready to attach actuation device module according to claim 10, wherein said housing parts are secured together with an adhesive.

18. A ready to attach actuation device module according to claim 10, wherein said housing parts are secured together with a snap fit.

19. An appliance comprising:

a dispenser with an electrically operated dispensing mechanism; and a ready to attach actuation device module comprising:

an electrical actuation device;

a wiring lead extending from said actuation device;

an electrical connector attached at an end of said wiring lead;

a housing enclosing said actuation device and at least a portion of said wiring lead and including all stylings for said actuation device module; and an attachment mechanism engageable with said dispenser;

said housing being formed in two parts, a first part including said attachment mechanism, and a second part being a front cover including said stylings, with said two parts being secured together without the use of separate mechanical fasteners;

said attachment mechanism comprising at least two clips extending from said first part of said housing and having an L shape, with a long leg portion extendable through an opening in a wall of the appliance and engageable against a surface of said appliance wall facing away from said housing to hold said housing against said appliance wall and a short leg portion restable on a lower edge of said opening to support said housing on said appliance wall, and at least one spring member positioned between said housing and said appliance wall to press against a surface of said appliance wall facing towards said housing.

* * * * *